US005341749A

United States Patent [19]

Noakes

[11] Patent Number: 5,341,749

[45] Date of Patent: Aug. 30, 1994

[54] GANGING LEG AND SWING PLATE CONSTRUCTION FOR TABLES

[75] Inventor: Laura A. Noakes, New York, N.Y.

[73] Assignee: Steelcase Inc., Grand Rapids, Mich.

[21] Appl. No.: 892,256

[22] Filed: Jun. 2, 1992

[51] Int. Cl.[5] ..... A47B 57/00

[52] U.S. Cl. ..... 108/64; 108/156; 248/188.8

[58] Field of Search ..... 108/64, 153, 154, 159, 108/27, 114, 156, 157, 158; 312/107, 107.5, 111; 211/207; 248/188, 188.8, 432, 440; 403/188

[56] References Cited

U.S. PATENT DOCUMENTS

| | | | |
|---|---|---|---|
| 1,225,234 | 5/1917 | Fox | 108/64 X |
| 3,342,147 | 9/1967 | Shettles | 108/64 |
| 3,385,239 | 5/1968 | Fossier et al. | 108/156 |
| 3,406,935 | 10/1968 | Mutchnik | 108/156 |
| 3,620,492 | 11/1971 | Jennings | 248/188 |
| 3,915,100 | 10/1975 | Sullivan | 108/64 |
| 4,064,814 | 12/1977 | Pokorny et al. | 108/64 |
| 4,112,859 | 9/1978 | Willenbacher | 112/217.1 |
| 4,150,630 | 4/1979 | Pokorny et al. | 108/64 |
| 4,383,487 | 5/1983 | Fitzner et al. | 108/27 |
| 4,409,906 | 10/1983 | Alneng | 108/114 X |
| 4,665,836 | 5/1987 | Burr | 108/64 |
| 4,716,840 | 1/1988 | Tringali et al. | 108/27 |
| 4,745,867 | 5/1988 | Niemiec | 108/157 |
| 4,805,542 | 2/1989 | Peterson et al. | 108/150 |
| 4,807,838 | 2/1989 | Anderson | 248/188.1 |
| 4,915,034 | 4/1990 | Grabe et al. | 108/65 |
| 5,035,186 | 7/1991 | Uredat et al. | 108/159 |
| 5,182,996 | 2/1993 | Gutgsell | 108/64 |

FOREIGN PATENT DOCUMENTS

| | | | |
|---|---|---|---|
| 2507496 | 8/1976 | Fed. Rep. of Germany | 108/64 |
| 1567787 | 5/1969 | France | 108/64 |
| 2100121 | 12/1982 | United Kingdom | 108/64 |

*Primary Examiner*—Clifford D. Crowder
*Assistant Examiner*—Ismael Izaguirre
*Attorney, Agent, or Firm*—Price, Heneveld, Cooper, DeWitt & Litton

[57] ABSTRACT

A table is provided with a gangable leg construction which permits the table to be used either as a stand alone unit, or ganged side-by-side with like tables for conferencing, dining and the like. The gangable leg construction includes a rigid mounting plate fastened to the bottom surface of a top portion of the table, and a swing plate fixedly mounted on the upper end of an associated leg. Fasteners detachably interconnect the mounting and swing plates in a manner which permits the leg to be shifted between a fully inboard position, underneath the top, for supporting the top in a stand alone fashion, and an outboard position, protruding outwardly from the top, for supporting the top, and an adjacent top of a like gangable table in a ganged fashion.

23 Claims, 1 Drawing Sheet

GANGING LEG AND SWING PLATE CONSTRUCTION FOR TABLES

BACKGROUND OF THE INVENTION

The present invention relates to furnishings for offices, dining rooms, meeting spaces, and the like, and in particular to a gangable table therefore.

Open spaces for offices, meetings, dining, and the like are frequently provided in commercial buildings, and other similar structures to accommodate large groups of people. Furnishings for such open spaces typically include multiple tables, which are preferably configurable in a wide variety of different arrangements to accommodate the specific needs of a particular group and/or occasion.

When such tables are arranged contiguously, such as side-by-side, end-to-end, etc. in a desired pattern, it is generally preferred that some type of positive ganging system be used to securely retain the tables in their set configuration. Heretofore, such ganging systems have typically not provided a very secure and positive type of connection which can be easily locked and unlocked without tools by even unskilled personnel. Further, some types of prior ganging arrangements have had a quite complicated construction, and are not readily convertible between stand alone and ganged configurations.

SUMMARY OF THE INVENTION

One aspect of the present invention is a gangable table having a top with at least one side edge shaped to permit mating abutment with an adjacent side edge of a like gangable table when positioned in a selected ganged relationship therewith. The top is supported by at least one ganging leg assembly, including a rigid leg having a swing plate fixedly mounted on the upper end thereof, which is shaped to matingly abut the bottom surface of the tabletop. Fasteners detachably mount the swing plate to the bottom surface of the top, and are positioned to permit the swing plate to shift between a first support position wherein the leg is positioned wholly inboard of the side edge, underneath the top, for supporting the top in a stand alone fashion, and a second position wherein the leg is positioned at least partially outboard of the side edge, protruding outwardly from the top, for supporting the top and an adjacent top of a like gangable table in a ganged fashion.

The principle objects of the present invention are to provide a gangable table with a very secure and positive type of ganging mechanism, which can be easily locked and unlocked by even unskilled personnel without any tools. A ganging leg assembly incorporated into the table has an uncomplicated design which facilitates manually reconfiguring the table between stand alone and ganged configurations. The table preferably includes glide mechanisms in the form of casters or the like, mounted on the lower ends of the legs to permit manual movement of the table across a floor surface. At least one side edge of the tabletop may be specially shaped for manual grasping to facilitate this manual movement. The gangable table is efficient in use, economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figures 1, 2, 3, 4, 5, 6, 7:
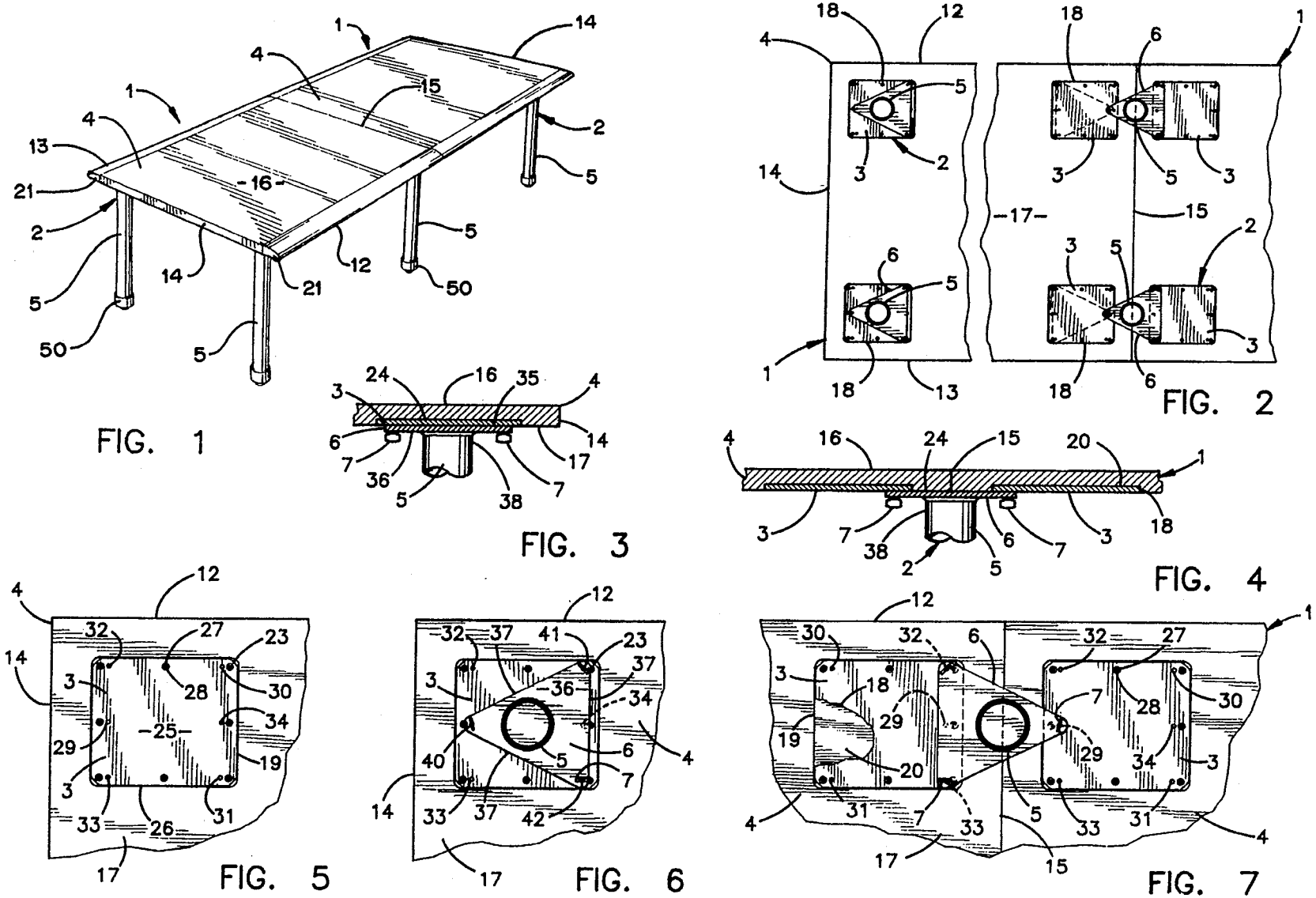
FIG. 1 is a perspective view of a pair of gangable tables embodying the present invention, shown in a ganged configuration.
FIG. 2 is a fragmentary, bottom plan view of the ganged tables shown in FIG. 1.
FIG. 3 is a fragmentary, vertical cross-sectional view of a ganging leg assembly portion of the table, shown in a stand alone support position.
FIG. 4 is a fragmentary, vertical cross-sectional view of the ganging leg assembly, shown in a ganged support position.
FIG. 5 is a fragmentary, bottom plan view of a mounting plate portion of the ganging leg assembly.
FIG. 6 is a fragmentary, bottom plan view of a pivot plate portion of the ganging leg assembly, shown attached to the mounting plate in the stand alone support position.
FIG. 7 is a fragmentary, bottom plan view of the ganging leg assembly, shown in the ganged support position, and connected with the mounting plate of an adjacent, like gangable table.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a gangable table embodying the present invention. In FIGS. 1 and 2, two substantially identical gangable tables 1 are illustrated, each of which includes at least one unique, gangable leg assembly 2, which permits each table 1 to be used either as a stand alone unit, or ganged together with like tables for conferencing, dining, and the like. Since tables 1 have a substantially identical construction, for ease of description herein, reference shall be had to only one of the tables 1, wherein each gangable leg assembly 2 includes a rigid mounting plate 3 (FIGS. 5–7) fastened to the bottom surface of an associated tabletop 4. Each gangable leg assembly 2 also includes a rigid leg 5 having a swing plate 6 fixedly mounted to the upper end thereof, and adapted to matingly abut with mounting plate 3. Fasteners 7 detachably connect swing plate 6 with mounting plate 3 in a manner which permits leg 5 to be shifted between a fully inboard position, underneath top 4, as shown in FIGS. 3 & 6, for supporting table 1 in a stand alone fashion, and an outboard position, protruding outwardly from top 4, as shown in FIGS. 4 & 7, for supporting table 1 in a ganged fashion.

The illustrated tabletop 4 (FIGS. 1–4) has a substantially rectangular plan configuration, and is defined by a front edge 12, a rear edge 13, and opposite side edges 14 and 15. Table top 4 has a substantially rigid construction, with a finished upper surface 16, and a bottom surface 17. Table top 4 preferably, has special lobe shaped portions 21 extending along the front and rear edges 12 and 13 thereof, which are particularly shaped and adapted for manual grasping to facilitate moving table 1 across a floor surface, as described in greater detail hereinafter. The bottom surface 17 of tabletop 4 includes four pockets or recesses 18 positioned adjacent each corner of tabletop 4. Recesses 18 are substantially identical in shape, and in the illustrated example, have a generally square plan configuration defined by opposite sidewalls 19 and a base 20. The depth of each recess 18 is substantially identical to the thickness of mounting plate 3, as described more fully below.

The illustrated mounting plate 3 (FIGS. 5–7) of gangable leg assembly 2 has a substantially square plan configuration, defined by a top surface 24, a bottom surface 25, and four opposite side edges 26. The corners 23 of mounting plate 3 are chamfered or beveled to facilitate reception into an associated one of the recess 18. In the example illustrated in FIGS. 5–7, mounting plate 3 includes six, countersunk through apertures 27, arranged in a regular pattern along side edges 26, in which suitable fasteners, such as the illustrated screws 28 are received to securely attach mounting plate 3 to the base 20 of recess 18. The heads of screws 28 are preferably countersunk flush into the bottom surface 25 of mounting plate 3, so as to present a 30 flat surface. Mounting plate 3 also includes six threaded swing plate mounting apertures 29–34. Threaded mounting apertures 29–31 are positioned in an equilateral triangular pattern on the bottom surface 25 of mounting plate 3, with mounting aperture 29 disposed nearest the adjacent side edge 14 of tabletop 4. Threaded mounting apertures 32 & 33 are positioned adjacent the corners 23 of mounting plate 3 nearest tabletop side edge 14, are symmetrical with threaded apertures 30 & 31, and in-line with threaded aperture 29. Threaded mounting aperture 34 is positioned diametrically opposite threaded mounting aperture 29, and in-line with threaded mounting apertures 30 & 31, such that mounting plate 3 is completely symmetrical between top side edges 14 and 15.

The illustrated swing plate 6 (FIGS. 6–7) of gangable leg assembly 2 has a substantially triangular plan configuration, in the form of an equilateral triangle, and is defined by a top surface 35, a bottom surface 36, and three opposite side edges 37. The upper end 38 of leg 5 is fixedly attached to the bottom surface 36 of swing plate 6 adjacent the geometric center thereof, such that the longitudinal or axially axis of leg 5 is coincident with the geometric center of swing plate 6. The upper end 38 of leg 5 may be attached to swing plate 6 by means such as welding, adhesives, or the like, such that they are suitably interconnected to securely support tabletop 4, as well as any objects positioned thereon. Swing plate 6 includes three, through apertures 40–42 positioned adjacent each corner or apex thereof, which are arranged in plan configuration substantially identical to the plan arrangement of mounting plate fastener apertures 29–31, so that they align vertically when mounting plate 3 and swing plate 6 are assembled in the manner shown in FIG. 6. In the illustrated arrangement, the anchor through aperture 40 is circular, while the other two through apertures 30 and 31 are slightly elongate in the direction of table top edges 12 and 13 to facilitate ganging adjacent tables 1 together, as described below. The top surface 35 of swing plate 6 is substantially flat, and adapted to abuttingly mate with the flat bottom surface 25 of mounting plate 3.

In the illustrated example, the lower end of each leg 5 is provided with some type of floor engaging glide mechanism, such as the illustrated ball caster 50, which facilitates translating table 1 across an associated floor surface. Preferably, table 1 can be pulled or pushed from one location to another by simply grasping one of the formed tabletop edges 12 or 13, and manually moving the same to the next desired location.

Fastener 7 serves to detachably interconnect each swing plate 6 with an associated mounting plate 3 in one of two positions, as described in greater detail below. The illustrated fasteners 7 are in the nature of knobs or thumbscrews, each of which includes a threaded shank and an enlarged head that facilitates manual rotation of fastener 7 without requiring any tools. Thumbscrews 7 are shaped to be received through each of the through apertures 40–42 in swing plate 6, and their ends threadedly received in the associated, aligned threaded mounting plate apertures 29–31. The through apertures 40–42 in swing plate 6, and threaded mounting apertures 29–33 in mounting plate 3 are arranged in a unique configuration which permits each of the swing plates 6 to be attached to its associated mounting plate 3 in two different positions to facilitate arranging the table 1 in either a stand alone configuration or a ganged configuration. More specifically, in the first position illustrated in FIGS. 3 & 6, the through apertures 40–42 in swing plate 6 are aligned vertically with threaded mounting apertures 29–31 of the associated mounting plate 3, such that the upper end 39 of the associated table leg 5 is positioned wholly inboard of the next adjacent side edge 14, underneath tabletop 4, and serves to support top 4 in a stand alone fashion. In the second position illustrated in FIGS. 4 & 7, the through aperture 40 in swing plate 6 remains vertically aligned with the associated threaded mounting aperture 29 and mounting plate 3, but the remaining two through apertures 41 and 42 in swing plate 6 are shifted 180 degrees from their stand alone position of FIG. 6, and are then vertically aligned with the threaded fastener apertures 32 and 33 in the next adjacent mounting plate 3. In the second position (FIGS. 4 & 7), the upper end 38 of the associated leg 5 is positioned at least partially outboard of side edge 14, protruding outwardly from tabletop 4, for supporting both top 4, as well as the top 4 of the next adjacent like table in a ganged fashion, as shown in FIGS. 1, 2 and 7. More specifically, in the second swing plate position (FIGS. 4 & 7), the central longitudinal axis of leg 5 is substantially aligned with the space between adjacent tabletop side edges 14/15, such that the upper end 38 of leg 5 is positioned directly beneath both adjacent side edges 14/15 of the adjacent tabletop 4 to rigidly support the same without sagging.

Gangable tables 1 operate in the following manner. When gangable tables 1 are to be used individually or separately in a stand alone configuration, each table 1 is provided with four of the gangable leg assemblies 2, wherein each swing plate 6 assumes the first position illustrated in FIGS. 3 & 6, with the upper end 38 of leg 5 positioned wholly inboard of the associated side edges 14 and 15 of tabletop 4. In each leg assembly 2, the apex associated with through aperture 40 of triangular swing plate 3 points toward the adjacent one of the top side edges 14 and 15. In this configuration, all four of the gangable leg assemblies 2 are fully retracted underneath the associated tabletop 4, so as to avoid obstructing free access and use of table 1 by the user.

When two or more tables 1 are to be used in a ganged configuration, two tables 1 are positioned in the side-by-side relationship illustrated in FIG. 1, wherein adjacent side edges 14 and/or 15 are aligned and abutting. The tops 4 of adjacent tables 1 are at the same height, so as to form a continuous, elongated, horizontal surface. On one of the tables 1, the two swing plates 6 located along the common edge 15 are first removed by loosening and removing fasteners 7, and detaching swing plates 6, and their attached legs 5 from the associated mounting plates 3. The removed legs 5 and attached swing plates 6 are stored appropriately for future use. On the next adjacent table 1, the two swing plates 6 positioned adjacent the common edge 15 are then shifted to the second position, so as to interconnect with the adjacent tabletop 4. Preferably, the shifting of swing plates 6 is achieved by removing the fasteners 7 in through apertures 41 and 42, while simply loosening the anchor fastener 7 in through fastener aperture 40. This permits the associated swing plate 6, to be rotated about the axis of through aperture 40 to thereby quickly and accurately position through apertures 41 and 42 vertically in line with the threaded mounting apertures 32 and 33 of the next adjacent mounting plate 3. The top surface 35 of each shifted swing plate 6 is flush with the bottom surfaces 25 of both adjacent mounting plates 3. The two removed fasteners 7 are then reinserted through the through apertures 41 and 42 of swing plates 6, and threaded into the associated threaded mounting apertures 32 and 33 of the next adjacent mounting plate 3, and tightened in place. The anchor fastener 7 associated with through aperture 40 is then retightened, such that the two swing plates 6 bridge the gap between the common side edges 15 of tabletops 4, and position the upper ends 38 of the associated two legs 5 directly beneath the common edge 15, as best illustrated in FIGS. 4 & 7 to securely support the adjacent tops 4 without any sagging.

Tables 1 can be reconfigured back into the stand alone configuration by simply reversing those steps described above. The symmetrical positioning of threaded mounting apertures 30–33 permits either pair of swing plates 6 adjacent the common edge 15 of two tables 1 to be used to gang the same together in a non-directional fashion.

The gangable leg assembly 2 incorporated into tables 1 provides a very secure, positive type of connecting mechanism, which can be readily configured and reconfigured even by unskilled personnel without requiring any tools.

In the foregoing description, it will be readily appreciated by those skilled in the art that modifications may be made to the invention without departing from the concepts disclosed herein. Such modifications are to be considered as included in the following claims, unless these claims by their language expressly state otherwise.

I claim:

1. A gangable table, comprising:

a top having a bottom surface, and at least one side edge for mating abutment when said top is positioned in a gaged relationship;

a leg arrangement supporting said top on a floor surface in a freestanding fashion, and including at least one ganging leg assembly, comprising:

a rigid leg having an upper end, and a lower end abutting the floor surface;

a swing plate fixedly mounted on the upper end of said leg, and matingly abutting the bottom surface of said top; and fasteners detachably mounting said swing plate to the bottom surface of said top, and positioned for shifting said swing plate between a first support position wherein said leg is positioned wholly inboard of said side edge, underneath said top, for supporting said top in a stand alone fashion, and a second support position wherein said leg is positioned at least partially outboard of said side edge, protruding outwardly from said top, for supporting both said top and an adjacent top in a ganged fashion; said swing plate being configured such that in said second support position, the upper end of said leg is positioned directly beneath both adjacent side edges of the adjacent tops to rigidly support the same without sagging.

2. A gangable table as set forth in claim 1, wherein:

said fasteners include an outboard fastener about which said swing plate is rotated between the first and second support positions to quickly and accurately locate said swing plate.

3. A gangable table as set forth in claim 2, wherein:

said swing plate has a generally triangular plan configuration with said fasteners positioned adjacent each apex of said swing plate.

4. A gangable table as set forth in claim 3, wherein:

said fasteners include thumbscrews to permit manually shifting said table between stand alone and ganged configurations without tools.

5. A gangable table as set forth in claim 4, wherein:

said swing plate is configured such that in said second support position, an uppermost surface of said swing plate is substantially flush with both bottom surfaces of the adjacent tops.

6. A gangable table as set forth in claim 5, wherein:

said ganging leg assembly includes a rigid mounting plate fixedly attached to the bottom surface of said top, and has said swing plate detachably fastened thereto.

7. A gangable table as set forth in claim 6, wherein:

said top includes a recess in the bottom surface in which said mounting plate is received.

8. A gangable table as set forth in claim 7, wherein:

said leg includes a glide connected with its lower end for permitting manual movement of said table across the floor surface.

9. A gangable table as set forth in claim 8, wherein:

said top includes at least one side edge shaped for manual grasping to facilitate manual movement of said table across the floor surface.

10. A gangable table as set forth in claim 9, wherein:

said glide means comprises a caster.

11. A gangable table as set forth in claim 1, wherein:

said fasteners include an outboard fastener about which said swing plate is rotated between the first and second support positions to quickly and accurately locate said swing plate.

12. A gangable table as set forth in claim 1, wherein:

said swing plate has a generally triangular plan configuration with said fasteners positioned adjacent each apex thereof.

13. A gangable table as set forth in claim 1, wherein:

said fasteners include thumbscrews to permit manually shifting said table between stand alone and ganged configurations without tools.

14. A gangable table as set forth in claim 1, wherein:

said ganging leg assembly includes a rigid mounting plate fixedly attached to the bottom surface of said top, and has said swing plate detachably fastened thereto.

15. A gangable table as set forth in claim 1, wherein:

said top includes at least one side edge thereof shaped for manual grasping to facilitate manual movement of said table across the floor surface.

16. A gangable table as set forth in claim 1, wherein:

said leg includes a glide connected with its lower end for permitting manual movement of said table across the floor surface.

17. A gangable leg construction for tables of the type having a top with a bottom surface and at lest one side edge for mating abuttment when the top is positioned in a ganged relationship, said leg construction comprising:

a rigid mounting plate shaped to be fixedly mounted on the bottom surface of the top adjacent the side edge thereof;

a rigid leg having an upper end positioned adjacent to said mounting plate, and a lower end abutting the floor surface;

a swing plate fixedly mounted on the upper end of said leg, and matingly abutting said mounting plate;

fasteners detachably mounting said swing plate to said mounting plate, and positioned for shifting said swing plate between a first support position wherein said leg is positioned wholly inboard of the side edge, underneath the top, for supporting the top in a stand alone fashion, and a second support position wherein said leg is positioned at least partially outboard of the side edge, protruding outwardly from the top, for supporting the top and an adjacent top in a ganged fashion; said swing plate being configured such that in said second support position, the upper end of said leg is positioned directly beneath both adjacent side edges of the adjacent tops to rigidly support the same without sagging.

18. A gangable leg construction as set forth in claim 17, wherein;

said fasteners include an outboard fastener about which said swing plate is rotated between the first and second support positions to quickly and accurately locate said swing plate.

19. A gangable leg construction as set forth in claim 18, wherein:

said swing plate has a generally triangular plan configuration with said fasteners positioned adjacent each apex of said swing plate.

20. A gangable leg construction as set forth in claim 19, wherein:

said fasteners include thumbscrews to permit manually shifting the table between stand alone and ganged configurations without tools.

21. A gangable leg construction as set forth in claim 20, wherein:

said ganging leg assembly includes a rigid mounting plate shaped to be fixedly attached to the bottom surface of the top, and has said swing plate detachably fastened thereto.

22. A gangable leg construction, comprising:

a rigid mounting plate shaped to be fixedly mounted on a furniture top adjacent an associated side edge, and including three threaded fastener apertures arranged in a triangular plan shape;

a rigid leg having an upper end positioned adjacent to said mounting plate, and a lower end abutting the floor surface;

a swing plate fixedly mounted on the upper end of said leg, and having a generally triangular plan shape with through apertures positioned adjacent each apex of said swing plate;

three fasteners extending through the through fastener apertures in said swing plate, and threadedly received in the threaded fastener apertures in said mounting plate for shifting said swing plate between a first support position wherein said leg is positioned wholly inboard of the side edge, underneath the top, for supporting the top in a stand alone fashion, and a second position, wherein said leg is positioned at least partially outboard of the side edge, protruding outwardly from the top, for supporting the top and an adjacent top in a ganged fashion.

23. A table, comprising:

a top having a generally rectangular top plan configuration, with opposite side edges for mating abutment when said top is positioned in a side-by-side, ganged relationship;

a ganging leg assembly positioned adjacent each corner of said top, and including:

a rigid leg having an upper end, and a lower end abutting the floor surface;

a swing plate fixedly mounted on the upper end of said leg, and matingly abutting an associated surface of said top;

fasteners detachably mounting said swing plate to the associated surface of said top, and configured for shifting said swing plate between a first support position wherein said leg is positioned wholly inboard of an associated one of said side edges for supporting said top in a stand along fashion, and a second support position wherein said leg is positioned at least partially outboard of said associated one of said side edges for supporting said top and an adjacent top in a ganged fashion; said swing plate being configured such that in said second support position, the upper end of said leg is positioned directly beneath both adjacent side edges of the adjacent tops to rigidly support the same without sagging.

* * * * *

UNITED STATES PATENT AND TRADEMARK OFFICE

CERTIFICATE OF CORRECTION

PATENT NO. : 5,341,749
DATED : August 30, 1994
INVENTOR(S) : Noakes

It is certified that error appears in the above-indentified patent and that said Letters Patent is hereby corrected as shown below:

Column 3, line 30,
Before "flat" delete --30--.

Column 5, line 65,
"gaged" should be --ganged--.

Column 7, line 19, Claim 17,
"lest" should be --least--.

Column 8, line 20, Claim 22,
After "through" insert --fastener--.

Column 8, line 51, Claim 23,
"along" should be --alone--.

Signed and Sealed this
Ninth Day of May, 1995

Bruce Lehman

*Attest:*

BRUCE LEHMAN

*Attesting Officer*

*Commissioner of Patents and Trademarks*